US008573759B2

(12) United States Patent
Nishimori

(10) Patent No.: US 8,573,759 B2
(45) Date of Patent: Nov. 5, 2013

(54) DROPLET DISCHARGING APPARATUS, IMAGE FORMING APPARATUS, AND BUBBLE SEPARATING METHOD

(75) Inventor: Takehiro Nishimori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/043,716

(22) Filed: Mar. 9, 2011

(65) Prior Publication Data

US 2011/0228020 A1 Sep. 22, 2011

(30) Foreign Application Priority Data

Mar. 17, 2010 (JP) ..... 2010-061011

(51) Int. Cl.
*B41J 2/19* (2006.01)

(52) U.S. Cl.
USPC ..... 347/86; 347/92

(58) Field of Classification Search
USPC ..... 347/92, 86
See application file for complete search history.

(56) References Cited

U.S. PATENT DOCUMENTS

| | | | | |
|---|---|---|---|---|
| 5,030,973 | A * | 7/1991 | Nonoyama et al. | 347/93 |
| 6,190,008 | B1 * | 2/2001 | Iwashita et al. | 347/92 |
| 7,118,206 | B1 * | 10/2006 | Stockwell et al. | 347/92 |
| 7,210,722 | B2 | 5/2007 | Bernstein et al. | |
| 7,210,772 | B2 * | 5/2007 | Sasaki | 347/86 |
| 7,452,065 | B2 * | 11/2008 | Ogawa | 347/92 |
| 2002/0109760 | A1 * | 8/2002 | Miyazawa et al. | 347/86 |
| 2003/0146958 | A1 * | 8/2003 | Aruga et al. | 347/85 |
| 2004/0196342 | A1 * | 10/2004 | Hara et al. | 347/86 |
| 2005/0062809 | A1 | 3/2005 | Yoshino et al. | |
| 2006/0125891 | A1 * | 6/2006 | Hanaoka et al. | 347/86 |
| 2007/0109362 | A1 | 5/2007 | Hori et al. | |
| 2008/0007605 | A1 * | 1/2008 | Sakurai et al. | 347/92 |
| 2008/0036829 | A1 * | 2/2008 | Nishioka et al. | 347/86 |
| 2008/0158322 | A1 * | 7/2008 | Yamada et al. | 347/92 |
| 2008/0218571 | A1 | 9/2008 | Nishimori | |
| 2009/0015644 | A1 * | 1/2009 | Shinada et al. | 347/92 |
| 2009/0033725 | A1 * | 2/2009 | Toba et al. | 347/86 |
| 2009/0160888 | A1 * | 6/2009 | Nishioka et al. | 347/7 |
| 2009/0231399 | A1 * | 9/2009 | Takemura et al. | 347/85 |
| 2009/0295891 | A1 * | 12/2009 | Wanibe | 347/92 |
| 2009/0322838 | A1 * | 12/2009 | Wanibe et al. | 347/86 |
| 2009/0322840 | A1 * | 12/2009 | Wanibe | 347/92 |
| 2010/0013896 | A1 * | 1/2010 | Ishizawa et al. | 347/86 |

(Continued)

FOREIGN PATENT DOCUMENTS

| | | |
|---|---|---|
| JP | 2000-94708 | 4/2000 |
| JP | 3543315 | 4/2004 |

(Continued)

OTHER PUBLICATIONS

Chinese Official Action dated Jun. 4, 2013 and English translation in connection with corresponding Chinese patent application No. 201110072677.2.

*Primary Examiner* — Matthew Luu
*Assistant Examiner* — Patrick King
(74) *Attorney, Agent, or Firm* — Cooper & Dunham LLP

(57) ABSTRACT

A droplet discharging apparatus for discharging droplets of a recording fluid includes a negative pressure portion and a pressurizing portion connected to the negative pressure portion via a valve. The pressurizing portion is disposed upstream of the valve in a direction of a flow of the recording fluid. The pressurizing portion includes a bubble storing area configured to separate and store bubbles of the recording fluid.

10 Claims, 11 Drawing Sheets

(56) References Cited

U.S. PATENT DOCUMENTS

| | | | | |
|---|---|---|---|---|
| 2010/0033544 | A1* | 2/2010 | Nozawa | 347/86 |
| 2010/0045757 | A1* | 2/2010 | Ito | 347/92 |
| 2010/0053285 | A1* | 3/2010 | Ito | 347/92 |
| 2010/0079567 | A1* | 4/2010 | Akatsuka et al. | 347/92 |
| 2010/0123756 | A1* | 5/2010 | Yamada et al. | 347/36 |
| 2010/0124676 | A1* | 5/2010 | Meschter et al. | 429/12 |
| 2010/0177132 | A1* | 7/2010 | Hanaoka et al. | 347/7 |
| 2010/0201763 | A1* | 8/2010 | Nishioka et al. | 347/86 |
| 2010/0201765 | A1* | 8/2010 | Paku et al. | 347/92 |
| 2010/0231668 | A1* | 9/2010 | Ito | 347/92 |
| 2010/0231669 | A1* | 9/2010 | Ito | 347/92 |
| 2011/0069125 | A1* | 3/2011 | Taga | 347/86 |

FOREIGN PATENT DOCUMENTS

| | | |
|---|---|---|
| JP | 2004-243543 | 9/2004 |
| JP | 2005-1302 | 1/2005 |
| JP | 2005-59274 | 3/2005 |
| JP | 2006-68904 | 3/2006 |
| JP | 2009143244 | 7/2009 |
| JP | 4396358 | 10/2009 |

* cited by examiner

DROPLET DISCHARGING APPARATUS, IMAGE FORMING APPARATUS, AND BUBBLE SEPARATING METHOD

BACKGROUND OF THE INVENTION

1. Field of the Invention

The present invention relates to a droplet discharging apparatus for forming an image by discharging droplets of a recording fluid, an image forming apparatus including the droplet discharging apparatus, and a bubble separating method implemented in the droplet discharging apparatus and the image forming apparatus.

2. Description of the Related Art

Image forming apparatuses include printers, facsimile machines, copy machines, plotters, and multifunction peripherals having multiple image forming functions. As an example of an image forming apparatus of a fluid-discharging recording type, an inkjet recording apparatus is known. In the inkjet recording apparatus, an image is formed (or recorded, transferred, or printed, for example) by discharging droplets of a recording fluid, such as ink, from the recording head onto a recording medium, such as a sheet of paper, as the recording medium is transported. The recording medium is not limited to a sheet of paper but may include various forms and materials to which the recording fluid can adhere, such as an OHP sheet.

There are two types of the image forming apparatus of the fluid-discharging recording type: a serial-type image forming apparatus that forms an image by discharging the droplets while the recording head is moved in a main-scan direction, and a line-type image forming apparatus that forms an image by discharging the droplets without moving the recording head.

The recording medium may include paper, thread, fibers, cloth, metal, plastics, glass, wood, and ceramics. The "image" herein may include anything resulting from the landing of the droplets of recording fluid on the recording medium. The "image" may include an image having no apparent meaning, such as a random pattern, as well as an image with some meaning, such as characters or figures. The recording fluid is not limited to ink but may include a DNA sample, a resist, or a pattern material. The "image" herein is not limited to two-dimensional images but may refer to an image formed on a three-dimensional object, or even a three-dimensional image.

Typically, an image forming apparatus of the droplet discharging system includes a recording head that discharges droplets of recording fluid; a detachable first liquid containing unit storing the fluid supplied to the recording head; and a replaceable second liquid containing unit capable of temporarily containing the fluid supplied from the first liquid containing unit via a fluid supply channel, and also storing air that may enter into the fluid supply channel from the outside. The second liquid containing unit may include a negative-pressure generating unit for creating a reduced-pressure by using the deformation of a flexible film caused by an internal spring.

The second liquid containing unit and the recording head may or may not be filled with the recording fluid in advance. When the second liquid containing unit or the recording head is filled with the recording fluid, fluid components may coagulate around the nozzles of the recording head during a long storage period, possibly causing a defective discharge operation. When the second liquid containing unit or the recording head is not filled with the recording fluid, bubbles may remain inside a fluid chamber of the recording head following the initial loading of recording fluid upon arrival of the image forming apparatus, possibly resulting in a defective discharge operation.

In a conventional technology, the second liquid containing unit and the recording head may be filled with a fluid (which may be referred to as a "filling fluid" or "introductory fluid") other than the recording fluid. Prior to starting a printing operation after arrival of the image forming apparatus, the filling fluid is suctioned out via a head nozzle surface and replaced with the recording fluid from the first liquid containing unit (see Patent Document 1, for example).

Specifically, the technology discussed in Patent Document 1 is directed to an ink filling method including the removal of bubbles in the inkjet head. Before filling the inkjet head with ink, the inkjet head is filled with a filling fluid having a higher viscosity than that of the ink in advance. The filling fluid used has a high viscosity ranging from 5 cPs to 50 cPs. It is discussed that the method prevents the generation of bubbles due to turbulence and the like when pouring the ink by using a purge unit (which is a maintenance unit) of the inkjet apparatus, thus enabling the gas/liquid substitution within the inkjet head without leaving bubbles. It is also discussed that the method is capable of substituting the filling fluid in the inkjet head with ink.

However, in a channel structure of the above second liquid containing unit, it is very difficult to substitute the filling fluid with ink when the air storing area of the second liquid containing unit is increased. Specifically, when the air storing area is large, stagnant areas with reduced flow speed may be present, resulting in a decrease in substitution efficiency. As a result, the drainage volume required for substitution increases, thus reducing efficiency. When the air storing area is provided in a negative pressure forming portion within the second liquid containing unit, the contained air may expand due to a change in temperature of the environment, resulting in a loss of the reduced-pressure state within the second liquid containing unit and possibly leading to a leakage of the ink from the head nozzle surface.

FIGS. 11A and 11B are a front view and a cross section, respectively, of a conventional head unit 55 including a sub-tank 15. The sub-tank 15 includes a fluid storing area 100 in which a negative-pressure may be formed and also a fluid can be stored, and an air storing area 101. The sub-tank 15 is connected to a recording head 14 via a filter 43. Within the sub-tank 15, a linked open/close valve 116 is installed as well known in the art and as described later with reference to FIG. 4. The fluid storing area 100 and the air storing area 101 are located on the side of the recording head with respect to the linked open/close valve 116; i.e., on the downstream side of the linked open/close valve 116. On the upstream side of the sub-tank 15, a fluid supply channel 16 and an ink tank 9 may be connected, as illustrated in FIG. 3.

The air storing area 101 of the sub-tank 15 provides a space for trapping bubbles that may enter through the fluid supply channel 16 or its various connecting portions during a long period of use. The air storing area 101 has a sufficiently large size so that the channel or the flow may not be closed or blocked by the air that floats and is collected at the top of the sub-tank 15. The sub-tank 15 and the recording head 14 are filled with a filling fluid in advance. The filling fluid may be substituted with ink by suctioning the filling fluid via a nozzle surface of the recording head 14 by using a cap (not illustrated) upon initial filling of the image forming apparatus upon delivery.

However, it has not been easy to completely substitute the filling fluid with ink because the upper portion of the air storing area 101 includes the stagnant area having a low flow speed, which prevents the easy mixing of the filling fluid with ink. In order to ensure the air storing area 101, the size of the sub-tank 15 may be increased. However, this results in an increase in the drainage volume for substituting the filling fluid with ink, resulting in a decrease in efficiency.

Further, because the air storing area 101 is communicated with the fluid storing area 100 including the negative-pressure forming unit, the stored air may expand due to a change in temperature of the environment, resulting in a loss of the reduced-pressure state within the fluid storing area 100 and potentially leading to the leakage of the ink via the head nozzle surface.

Patent Document 1 does not discuss these issues in connection with the structure of the liquid containing unit or the presence/absence of the air storing area, or does not even mention fluid substitution efficiency. Thus, the method according to Patent Document 1 is not capable of easily substituting the filling fluid with ink when the air storing area in the second liquid containing unit is increased.

Patent Document 1: Japanese Laid-open Patent Publication No. 2000-94708

SUMMARY OF THE INVENTION

It is therefore an object of the present invention to overcome the aforementioned problems of the related art.

A more specific object of the invention may be to increase fluid substitution efficiency while ensuring a sufficient air storing area and without causing a loss of negative-pressure even when a temperature change is caused in the environment.

In one aspect, a droplet discharging apparatus for discharging droplets of a recording fluid includes a negative pressure portion; and a pressurizing portion connected to the negative pressure portion via a valve. The pressurizing portion is disposed upstream of the valve in a direction of a flow of the recording fluid. The pressurizing portion includes a bubble storing area configured to separate and store bubbles of the recording fluid.

In another aspect, an image forming apparatus includes the droplet discharging apparatus.

In another aspect, a bubble separating method is performed in a droplet discharging apparatus for discharging droplets of a recording fluid, the droplet discharging apparatus including a pressurizing portion connected to a negative pressure portion via a valve. The pressurizing portion is disposed upstream of the valve in a direction of a flow of the recording fluid. The pressurizing portion includes a bubble storing area. The method includes supplying the recording fluid into the pressurizing portion from the outside; separating bubbles in the recording fluid in the pressurizing portion; and storing the bubbles in the bubble storing area.

DETAILED DESCRIPTION OF THE PREFERRED EMBODIMENTS

In accordance with an embodiment of the present invention, in a recording head configured to discharge droplets of recording fluid, bubbles are separated and trapped on the pressurizing (upstream) side of a valve in order to minimize the presence of bubbles on the negative-pressure (downstream) side. In this way, the loss of negative-pressure and the leakage of droplets can be prevented, while improving the efficiency of substitution of the filling fluid with the recording fluid and reducing the drainage volume during the substituting operation.

Embodiments of the present invention are described with reference to the drawings.

Embodiment 1

Figure 1:
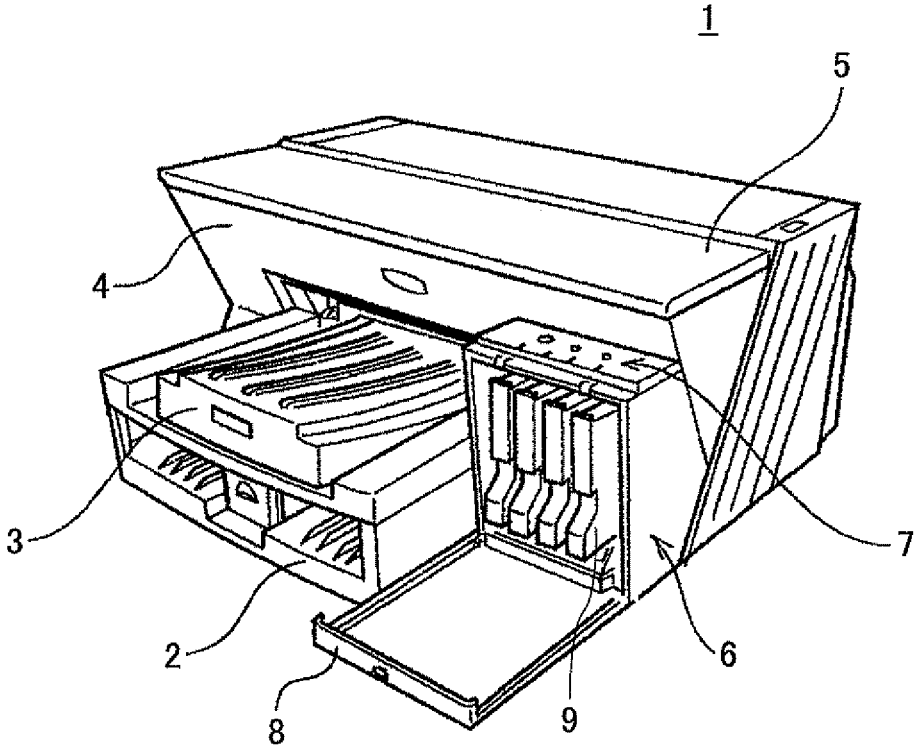
FIG. 1 is a perspective view of an image forming apparatus according to an embodiment of the present embodiment.
Figure 2:
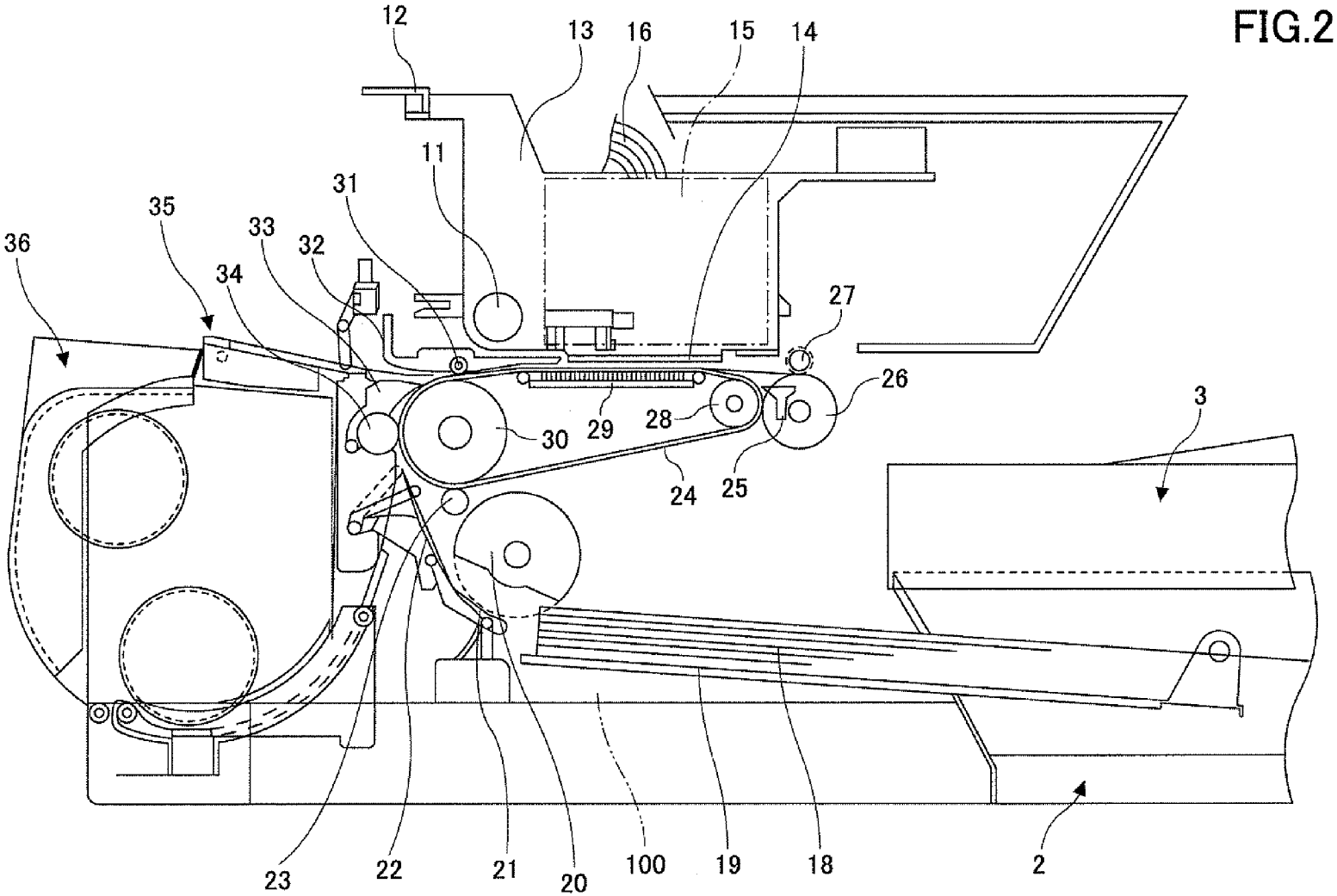
FIG. 2 illustrates a mechanism portion of the image forming apparatus.
Figure 3:
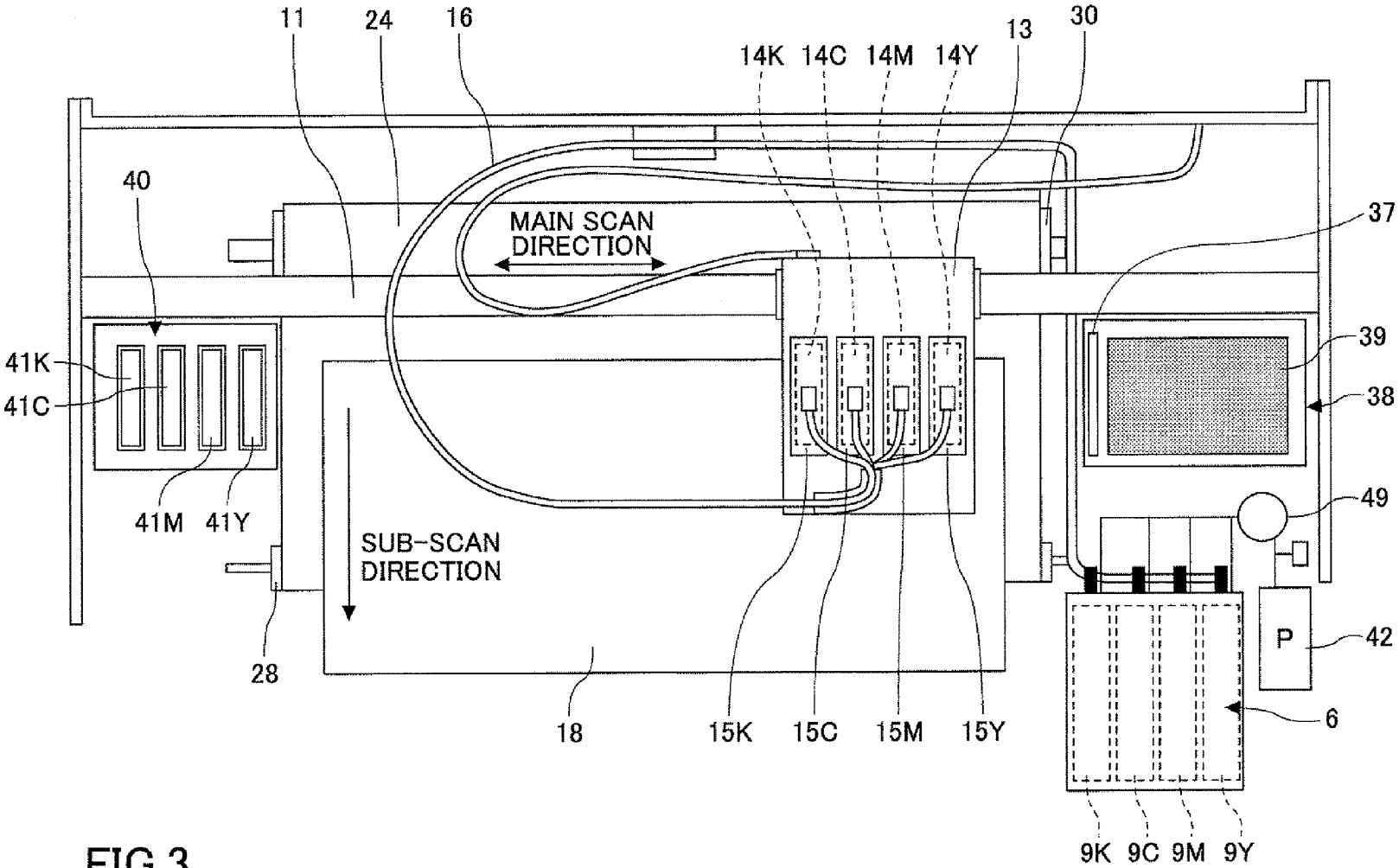
FIG. 3 is a plan view of main portions of the mechanism portion.

FIG. 1 is a perspective view of an image forming apparatus 1 according to Embodiment 1. FIG. 2 illustrates a mechanism portion of the image forming apparatus 1. FIG. 3 is a plan view of main portions of the mechanism portion. Referring to FIG. 1, the image forming apparatus 1 includes an apparatus main body 1, a sheet-feeding tray 2 for stocking sheets of a recording material (recording medium), and an ejected-sheet tray 3 for stocking sheets after an image forming operation. The image forming apparatus 1 further includes a (main) ink tank loading unit 6 disposed on one end of a front surface 4 of the apparatus main body 1. On top of the ink tank loading unit 6, an operating unit 7 including operating keys and display units and the like may be disposed. The ink tank loading unit 6 may also include a front cover 8 which may be opened to allow the removal or attaching of a (main) ink tank 9, which may be referred to as a first liquid containing unit.

As illustrated in FIGS. 2 and 3, a carriage 13 is slidably supported by a guide rod 11 (guide member) laterally extended between side plates (not illustrated) on the left and right sides of the apparatus main body, and a stay 12. The carriage 13 is moved in a main-scan direction indicated by arrows by a main-scan motor (not illustrated) in a scanning motion.

The carriage 13 carries recording heads 14Y, 14C, 14M, and 14K (any of which may be referred to as "the recording head 14"), which are fluid discharge heads configured to discharge droplets of recording fluid of the various colors yellow (Y), cyan (C), magenta (M), and black (Bk). The recording head 14 may have plural ink discharge openings (nozzles) arranged in a direction perpendicular to the main-scan direction and directed downward so that they can discharge the droplets downward onto a recording medium.

The droplet discharge head may include a discharge pressure generating unit (actuator unit) which is not particularly limited. While the various colors of the ink droplets are discharged by the individual recording heads 14Y, 14C, 14M, and 14K in accordance with the present embodiment, a single recording head may include nozzles configured to discharge the various colors of ink droplets.

The carriage 13 also carries a sub-tank 15 (15Y, 15C, 15M, 15K) which is a second liquid containing unit for supplying the various colors of ink to the recording head 14. The sub-tank 15 may be supplied with the various colors of ink from ink tanks 9Y, 9C, 9M, and 9K for the various colors, via a supply tube 16 (fluid supply channel). The ink tanks 9Y, 9C, 9M, and 9K store the ink of the various colors yellow (Y), cyan (C), magenta (M), and black (Bk), respectively. The sub-tank 15 functions as a buffer tank and temporarily stores the fluid supplied from the main tank 9 before supplying it to the recording head 14.

The image forming apparatus 1 may include a sheet-feeding unit for feeding the sheet 18 stacked on a sheet-stacking portion (pressure plate) 19 of the sheet-feeding tray 3. The sheet-feeding unit may include a half-moon roller (sheet-feeding roller) 20 for separately feeding the sheet 18 from the sheet-stacking portion 19. A separating pad 21 made of a material with a large friction coefficient may be disposed opposite the sheet-feeding roller 20. The separating pad 21 is biased toward the sheet-feeding roller 20.

The sheet 18 is thereafter transported under the recording head 14 by a transport unit. The transport unit may include a transport belt 24 configured to electrostatically adsorb the sheet 18. The sheet 18, as it is fed from the sheet-feeding unit via a guide 22, is pressed onto the transport belt 24 by a counter roller 34. The direction of transport of the sheet 18 is changed by approximately 90° by a transport guide 33 such that the sheet 18 may follow the transport belt 24. An edge-pressing roller 31 is biased toward the transport belt 24 by a pressing member 32. The surface of the transport belt 24 may be charged by a charging roller 23 which is a surface charging unit.

The transport belt 24 includes an endless belt extended across a transport roller 30 and a tensioning roller 28. The transport belt 24 is rotated in a belt transport direction indicated in FIG. 3, which may correspond to a sub-scan direction. The charging roller 23 is disposed in contact with the surface of the transport belt 24 so that the charging roller 23 can be rotated by the rotation of the transport belt 24.

Within the loop of the transport belt 24, a guide member 29 is disposed at a location corresponding to a printing area of the recording head 14. The guide member 29 is disposed such that its upper surface is located more toward the recording head 14 than a line connecting the upper edges of the transport roller 30 and the tensioning roller 28 supporting the transport belt 24. Thus, the transport belt 24 is pushed up in the printing area by the top surface of the guide member 29, thus ensuring a high level of flatness of the transport belt 24 in the printing area.

On the side of the guide member 29 that contacts the back side of the transport belt 24, plural grooves may be formed in a direction perpendicular to the main-scan direction, i.e., in the belt transport direction, in order to minimize the area of contact with the transport belt 24 so that the transport belt 24 can be moved along the surface of the guide member 29 smoothly. The sheet 18 that has been recorded by the recording head 14 may be ejected by a sheet-ejecting unit including a separating nail 25 for separating the sheet 18 from the transport belt 24, a sheet-ejecting roller 26, and an ejecting roller 27. An ejected-sheet tray 3 may be disposed under the sheet-ejecting roller 26. The height between the point of contact between the sheet-ejecting roller 26 and the ejecting roller 27 and the ejected-sheet tray 3 may be adjusted such that the number of sheets stacked in the ejected-sheet tray 3 can be maximized.

Further, a double-side sheet feeding unit 36 is detachably installed behind the apparatus main body 1. The double-side sheet feeding unit 36 is configured to take in the sheet 18 returned by an inverted rotation of the transport belt 24, invert the sheet 18, and again feed the sheet 18 between the counter roller 34 and the transport belt 24. On top of the double-side sheet feeding unit 36, a manual-feed unit 35 may be installed.

As illustrated in FIG. 3, in a non-printing area on one end of the carriage 13 along the scan direction, there may be provided an air supply pump apparatus 42 for applying an air pressure to the ink tanks 9Y, 9C, 9M, and 9K. The applied pressure may be opened to the atmosphere as needed by an atmosphere opening valve 49. The waste ink that may be discharged before or during a recording operation and that does not contribute to recording may be collected by a waste-ink collecting unit 39. A wiper blade 37 is provided for wiping the nozzle surface. Numeral 38 designates a maintenance/recovery mechanism as a whole.

In another non-printing area on the other end of the carriage 13 along the scan direction, a capping apparatus 40 may be disposed. The capping apparatus 40 may include a cap 41 (41K, 41C, 41M, 41Y) as a sealing unit for sealing the nozzles by capping the nozzle surface of the recording head 14.

Figure 4A:
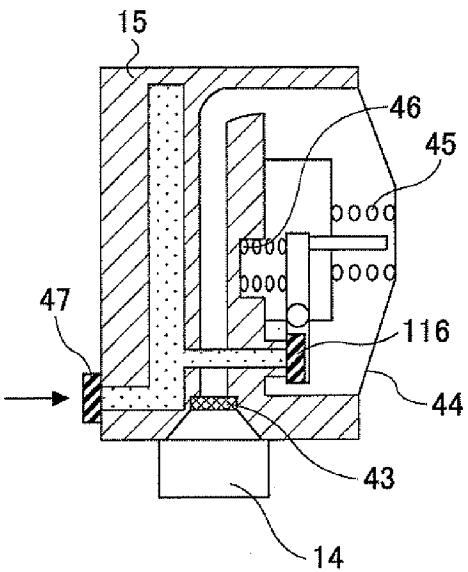
FIGS. 4A, 4B, and 4C are cross sections of a sub-tank and a recording head according to an embodiment of the present invention.
Figure 4B:
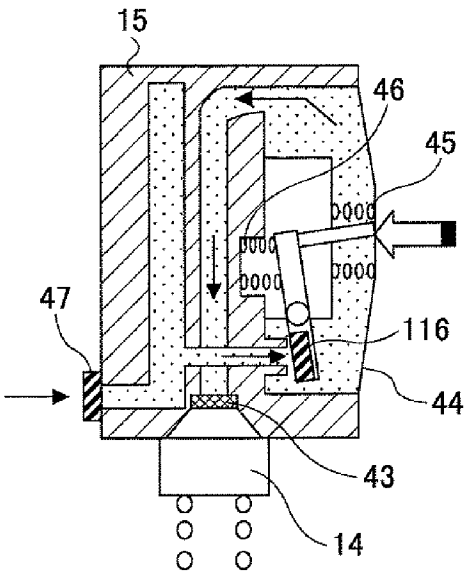
Figure 4C:
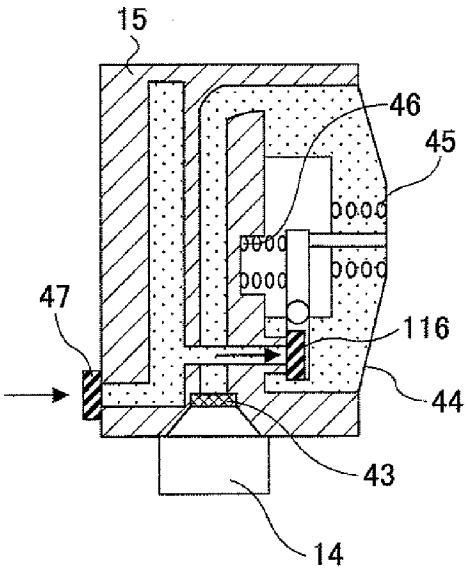

FIGS. 4A, 4B, and 4C are cross sections of the sub-tank 15 (second liquid containing unit) and the recording head 14. As illustrated, the sub-tank 15 is integrally attached to the recording head 14 via a filter 43, forming a head unit 55 which is mounted on the carriage 13 as described above. In the sub-tank 15, a linked open/close valve 116 is disposed which is configured to close or open the communication between the supply tube 16 and the recording head 14 depending on a reduced-pressure state within the recording head 14 caused by ink consumption by printing. The linked open/close valve 116 includes a packing portion having a resilient material, which may be formed by double molding. The linked open/close valve 116 is biased by a spring 46 disposed in the sub-tank 15. A flexible film 44 is welded onto the sub-tank 15 and is biased by another spring 45 in the sub-tank 15.

Referring to FIG. 4A, as the ink is discharged from the recording head 14, the volume of ink in the sub-tank 15 decreases and the flexible film 44 gradually contracts. As the ink is further discharged, the flexible film 44 contacts one end of the linked open/close valve 116, as illustrated in FIG. 4B, thus opening the linked open/close valve 116 and communicating the sub-tank 15 with the upstream side of the supply channel. When the discharge of ink from the recording head 14 is stopped, the linked open/close valve 116 is closed, as illustrated in FIG. 4C, so that the communication between the sub-tank 15 and the supply channel upstream side is blocked. At this time, the flexible film 44 is in contact with the end of the linked open/close valve 116, and the total force of the springs 45 and 46 is balanced with the pressure within the sub-tank 15.

Figure 5:
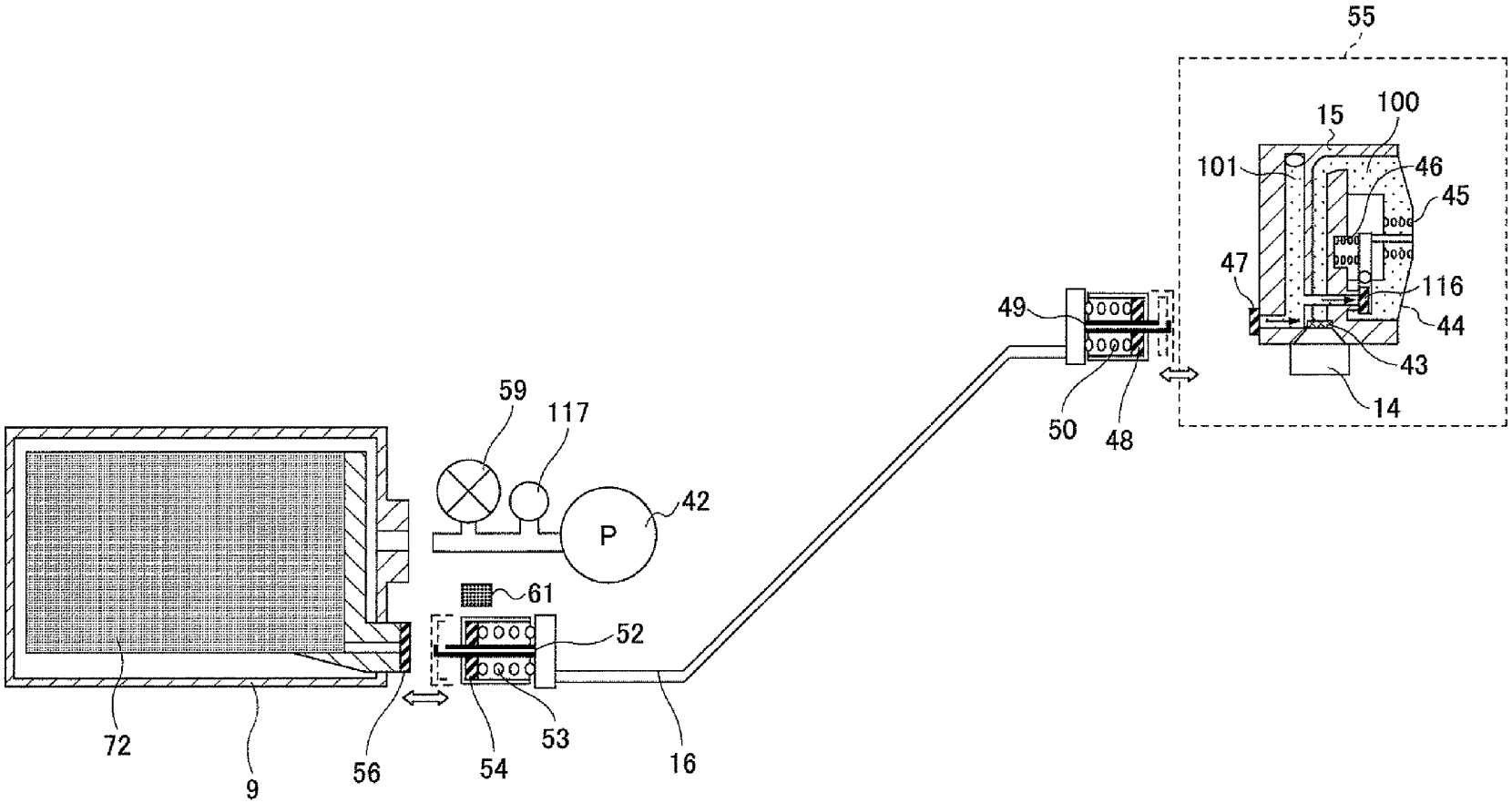
FIG. 5 illustrates an ink supply system according to an embodiment of the present invention.

FIG. 5 illustrates an example of the ink supply system. In FIG. 5, an ink bag 72 is contained in the ink tank 9 (first liquid containing unit). The ink bag 72 may be deformed by external pressure. A rubber seal 56 is integrally attached to the ink tank 9 where the ink tank 9 is connected to the fluid supply channel 16. On both ends of the fluid supply channel 16, coupling mechanism portions including supply needles 52, 49, rubber seals 54, 48, and springs 53, 50 are provided. When detached, the supply needle 52, 49 is covered and thus protected by the rubber seal 54, 48 which is moved by the spring 53,50. When the ink tank 9 is attached to the apparatus main body, the supply needle 52 penetrates the rubber seal 56 of the ink tank 9 so that the ink bag 72 and the fluid supply channel 16 can be communicated with each other. At this time, the ink tank 9 is also connected to the air supply pump apparatus 42 and the atmosphere opening valve 49 installed within the apparatus main body. Status of connection of the ink tank 9 may be detected by an ink tank detecting unit 61 provided in the apparatus main body.

The ink tank 9 may be installed within the main body apparatus at a height lower than that of the linked open/close valve 116 in the sub-tank 15. In this way, bubbles that may enter the supply channel 16 during a standby period may be more readily guided into the sub-tank 15.

When a print command is inputted into the apparatus main body, the atmosphere opening valve 59 is closed and then the air supply pump apparatus 42 is activated. As a result, air is supplied into the ink tank 9 and presses the ink bag 72, thus causing the ink to be supplied. The channel pressure detecting unit 117 may be configured to drive the air supply pump 42 such that a predetermined ink supply pressure can be obtained.

Figure 6B:
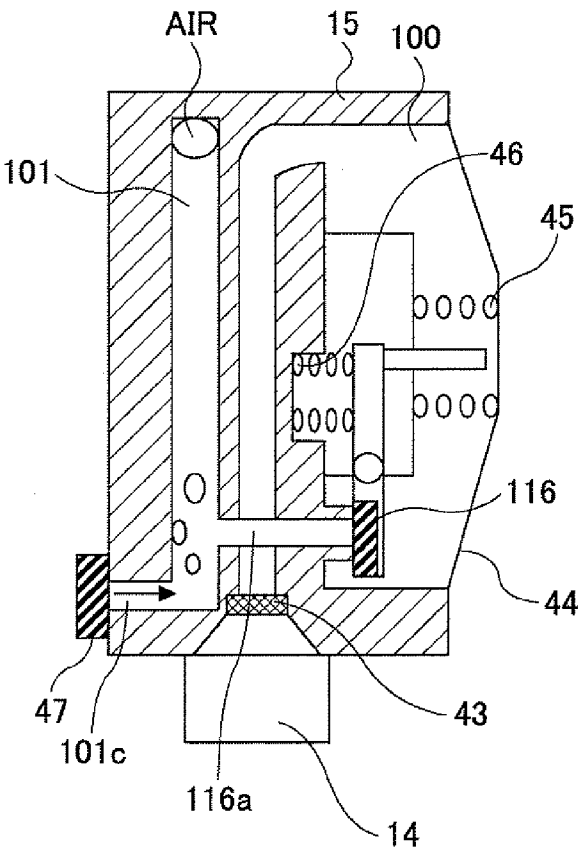
FIGS. 6A and 6B are a front view and a cross section, respectively, of a sub-tank according to an embodiment.
Figure 6A:
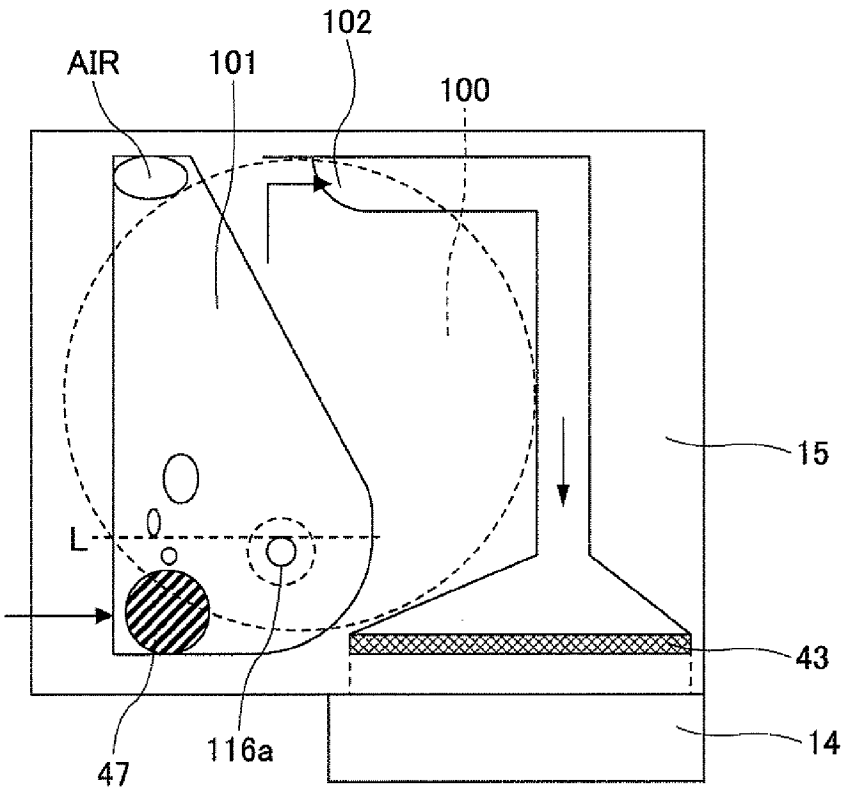

FIGS. 6A and 6*b* are a front view and a cross section, respectively, of the sub-tank 15. As illustrated, the sub-tank 15 includes an air storing area 101 and a fluid storing area 100. The fluid storing area 100 is connected to the recording head 14 via the filter 43. In accordance with the present embodiment, the air storing area 101 is on the pressurizing side to which ink is supplied from the outside. The fluid storing area 100 is on the negative-pressure side into which ink is suctioned from the air storing area 101. Thus, the air storing area 101 may be referred to as a "pressurizing portion" and the fluid storing area 100 may be referred to as a "negative pressure portion".

As mentioned above, the linked open/close valve 116 includes the packing portion having a resilient material. The linked open/close valve 116 is biased in a closing direction at all times by the spring 46 in the sub-tank 15. The flexible film 44 welded onto the sub-tank 15 is biased by the spring 45 in a direction such that the fluid storing area 100 is increased. Thus, a negative-pressure is created in the recording head 14 and the fluid storing area 100 as the flexible film 44 is biased by the recovery force provided by the springs 45 and 46.

The air storing area 101 is located immediately next to an ink inlet 101*c* and upstream of the linked open/close valve 116 with respect to the recording head 14. The fluid storing area 100 is located downstream of the linked open/close valve 116. This structure prevents the loss of reduced-pressure within the fluid storing area 100 or the resultant leakage of ink via the head nozzle surface occur, as may happen in conventional examples, even when the air contained in the air storing area 101 is expanded. A rubber seal 47 is attached to the ink inlet 101*c*. The ink flows into the fluid storing area 100 from a lower portion of the sub-tank 15 and guided into the recording head 14 via an upper channel 102.

The sub-tank 15 and the recording head 14 may be filled with a filling fluid in advance. The filling fluid may be substituted with ink by suctioning the filling fluid via the nozzle surface of the recording head 14 using a cap (not illustrated) upon initially filling the recording head 14 and the sub-tank 15 with ink upon arrival of the image forming apparatus.

Thus, the communication between the air storing area 101 of the sub-tank 15 and the fluid storing area 100 equipped with the negative-pressure forming unit may be intermittently closed by the open/close valve 116. Thus, the air that may enter the fluid supply channel 16 floats and becomes trapped in an upper area of the air storing area 101 in the form of bubbles, thus preventing the entry of the air into the fluid storing area 100. In this way, the loss of negative-pressure in the fluid storing area 100 due to the expansion of air in the air storing area 101 can be prevented even when the temperature of the environment is varied.

The maximum amount of air that can be stored in the air storing area 101 may be determined by the area that does not block the communicating channel 116*a*, namely, by the area above a line L illustrated in FIG. 6A. The line L is tangential to the upper edge of the communicating channel 116*a*, via which a fluid pressure is applied to the linked open/close valve 116. The line L thus defines a limit position beyond which the stored air may enter the communicating channel 116*a*. The position of the channel 116*a* may be set in view of the amount of air to be stored, the fluid pressure applied to the linked open/close valve 116, and the recovery force applied to the linked open/close valve 116 due to the springs 45 and 46.

Embodiment 2

Figure 7B:
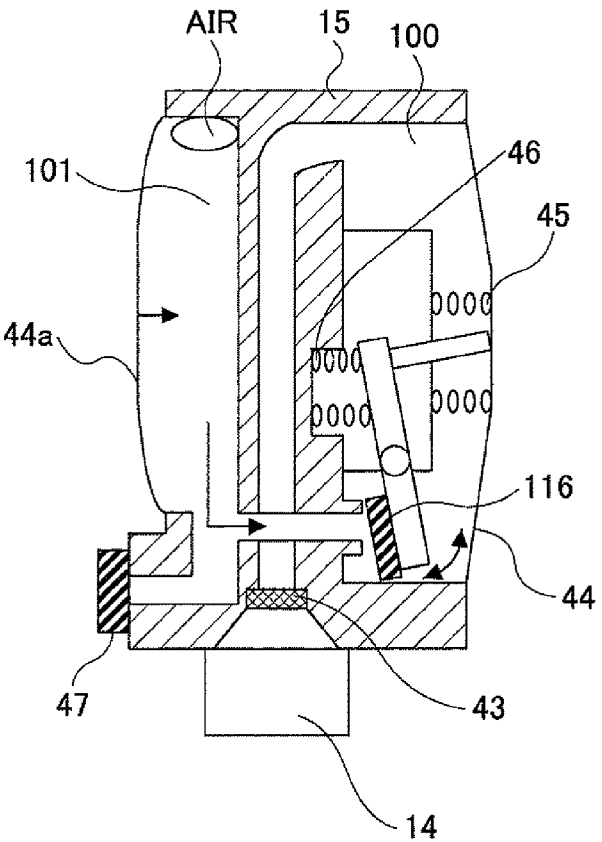
FIGS. 7A and 7B are a front view and a cross section, respectively, of a sub-tank according to an embodiment.
Figure 7A:
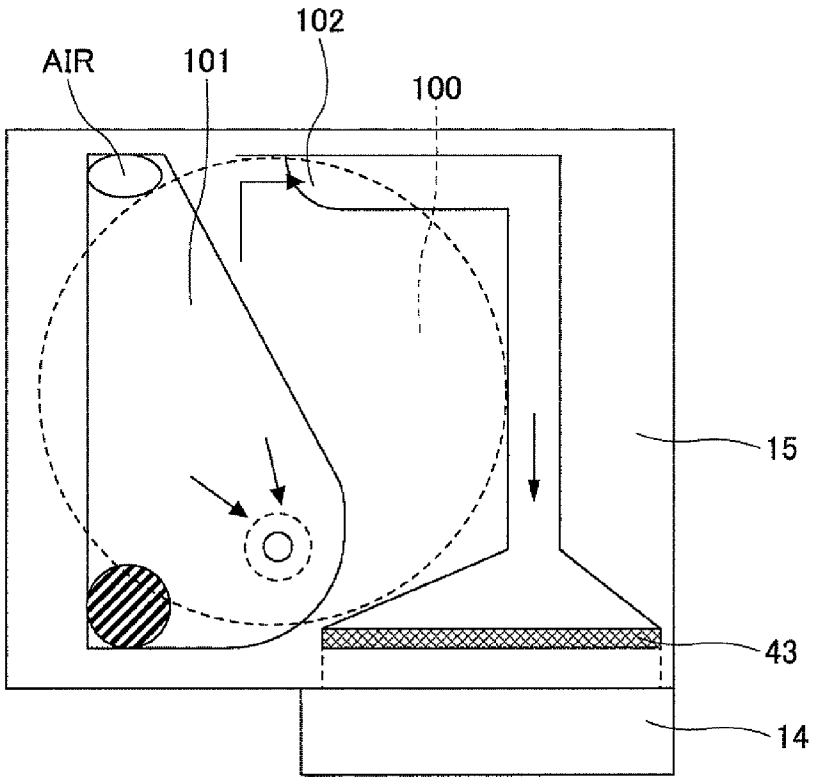

FIGS. 7A and 7B are a front view and a cross section, respectively, of the sub-tank 15 according to Embodiment 2. The sub-tank 15 according to Embodiment 2 differs from the sub-tank 15 of Embodiment 1 in that the back side of the air storing area 101 is formed by a flexible film 44*a*.

By thus forming the back side of the air storing area 101 with the flexible film 44*a*, an opening area larger than that of the supply channel 16 can be obtained. Further, the volume of the air storing area 101 can be varied temporarily, thus reducing fluid resistance. Thus, the fluid in the air storing area 101 is preferentially caused to flow into the fluid storing area 100, so that the air that may enter the supply channel 16 can be prevented from being discharged into the fluid storing area 100.

Thus, the sub-tank 15 has a structure that prevents the entry of air into the fluid storing area 100 having the negative-pressure forming unit. As a result, the loss of negative-pressure by the expansion of the stored air due to a change in the ambient temperature can be prevented.

Other portions of the sub-tank 15 according to Embodiment 2 may be similar in structure or function.

Embodiment 3

Figure 8B:
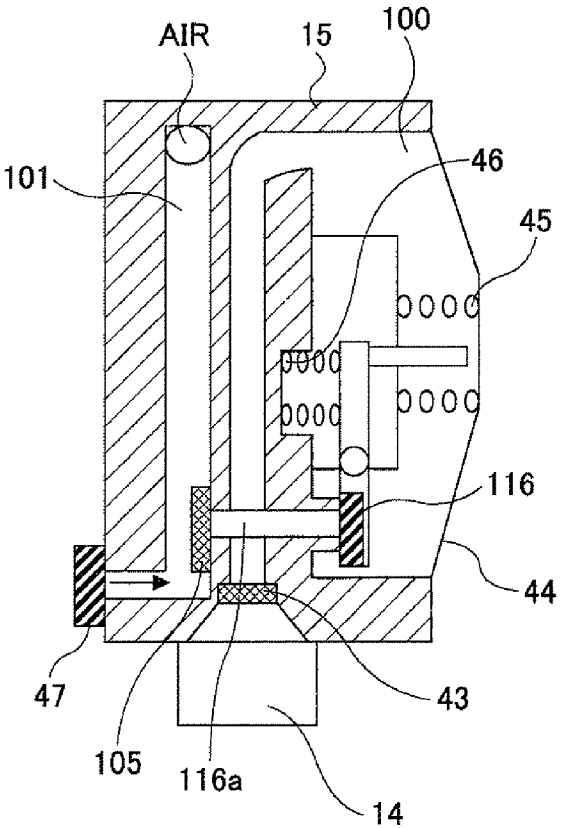
FIGS. 8A and 8B are a front view and a cross section, respectively, of a sub-tank according to an embodiment.
Figure 8A:
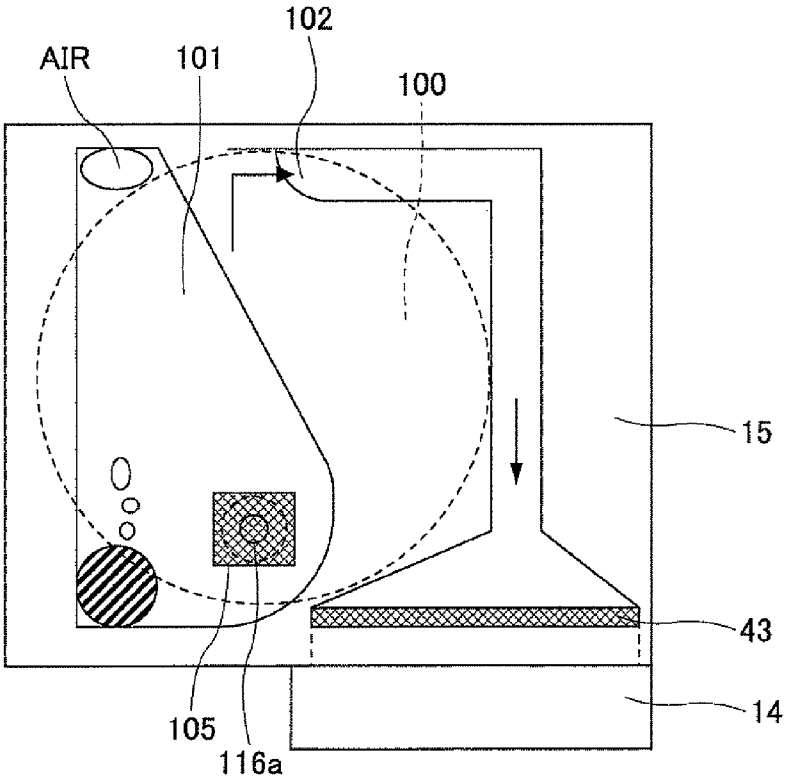

FIGS. 8A and 8B are a front view and a cross section, respectively, of the sub-tank 15 according to Embodiment 3. The sub-tank 15 according to Embodiment 3 differs from that of Embodiment 1 in that a filter 105 is provided at the boundary between the communicating channel 116*a* and the air storing area 101, namely, at an inlet portion via which the fluid enters into the communicating channel 116*a* from the air storing area 101.

According to the present embodiment, even if bubbles enter into the air storing area 101 together with the fluid from the supply channel 16 when the linked open/close valve 116 is opened upon printing, the flow rate of the fluid is slowed and the bubbles are blocked by the filter 105, thus trapping the bubbles within the air storing area 101. The filter 105 may be made of a material having a small porosity or a small cell density in order to effectively capture small bubbles.

Thus, the loss of negative-pressure by the expansion of the stored air which may be caused by a temperature change in the environment can be prevented.

Embodiment 4

Figure 9B:
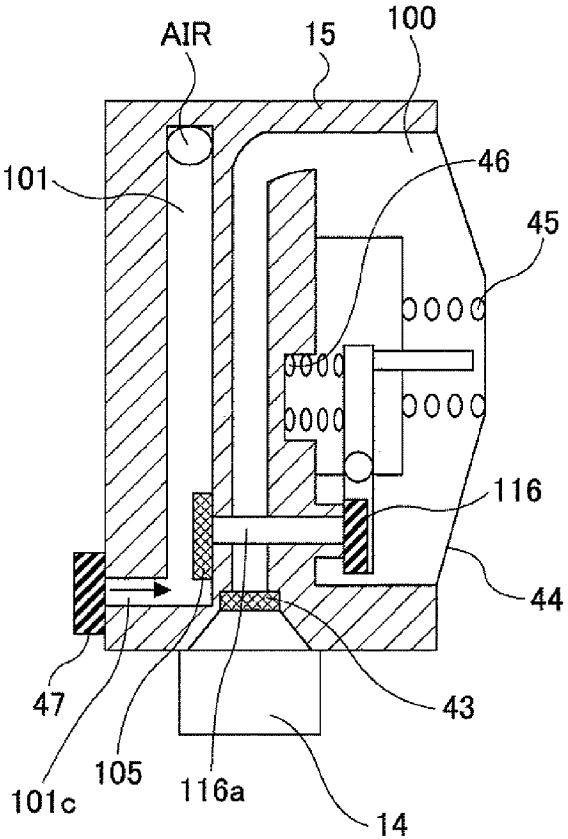
FIGS. 9A and 9B are a front view and a cross section, respectively, of a sub-tank according to an embodiment.
Figure 9A:
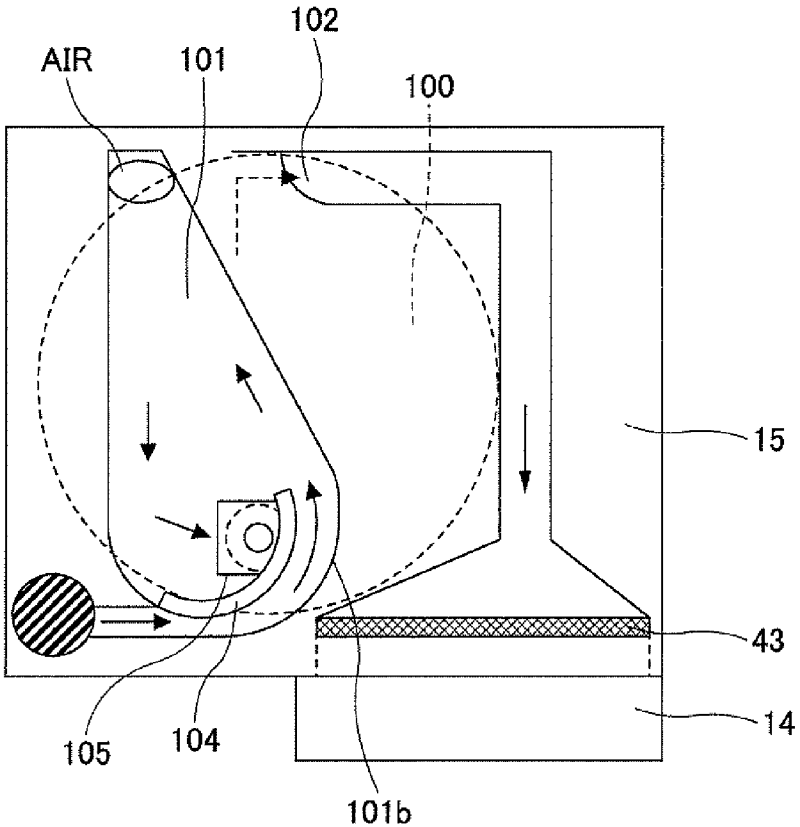

FIGS. 9A and 9B are a front view and a cross section, respectively, of the sub-tank 15 according to Embodiment 4.

The sub-tank 15 of Embodiment 4 differs from Embodiment 3 in that a flow regulating member 104 is further provided in the sub-tank 15. The flow regulating member 104 regulates the flow of ink from the ink inlet 101*c* in a predetermined direction such that the ink may flow upward along a side wall 101*b* parallel to the channel of the air storing area 101. The inlet portion of the communicating channel 116*a* is positioned behind an ink inlet side of the regulating member 104. Thus, the ink flows along a circular path before entering the communicating channel 116*a* via the filter 105, as indicated by arrows illustrated in the air storing area 101 in FIG. 9A.

Thus, even if bubbles enter the air storing area 101 from the supply channel 16 together with ink when the linked open/close valve 116 is opened upon printing and the air storing area 101 and the fluid storing area 100 are communicated, the flow rate of ink is slowed, so that the bubbles can be effectively captured by the filter 105 and trapped within the air storing area 101. The shape of the regulating member 104 is not limited to the one illustrated in FIG. 9 as long as the shape is such that it can cause the circular flow of the ink that enters via the ink inlet 101*c*. Thus, various shapes of the regulating member 104 may be selected depending on the position of the ink inlet 101*c* or the position of the inlet portion of the communicating channel 116*a*, for example.

Thus, in accordance with the present embodiment, the circular flow produced by the flow regulating member 104 allows the ink to flow through the upper portion of the air storing area 101, where the ink or the filling fluid may tend to stagnate. As a result, the mixing ratio of the filling fluid and ink can be increased, and hence improved substitution efficiency can be obtained. Thus, the drainage volume during ink substitution can be reduced. Further, the loss of negative-pressure by the expansion of the stored air by a temperature change in the environment can be prevented, as in the foregoing embodiments.

Embodiment 5

Figure 10B:
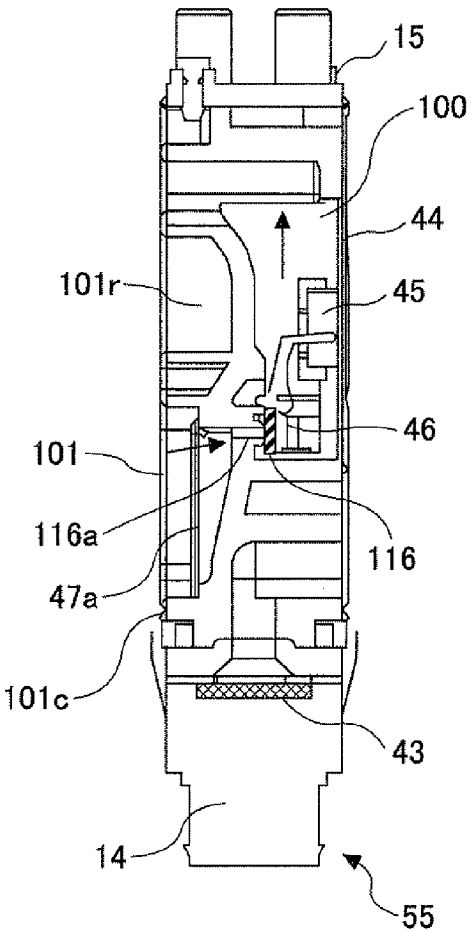
FIGS. 10A and 10B are a front view and a cross section, respectively, of a sub-tank according to an embodiment.
Figure 10A:
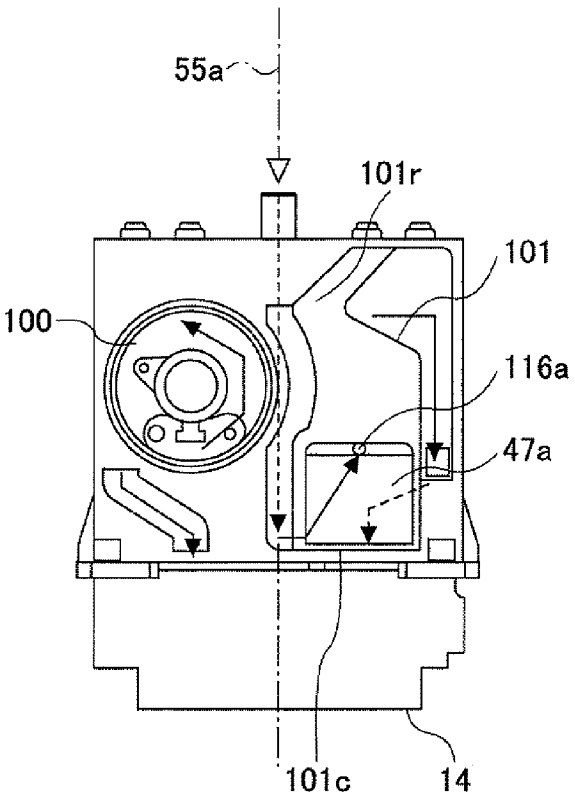
Figure 11B:
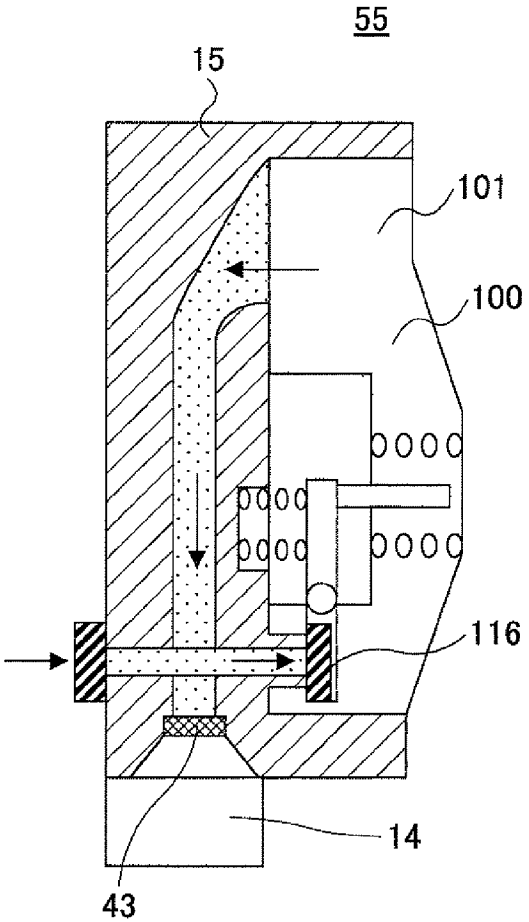
FIGS. 11A and 11B are a front view and a cross section, respectively, of a conventional sub-tank.
Figure 11A:
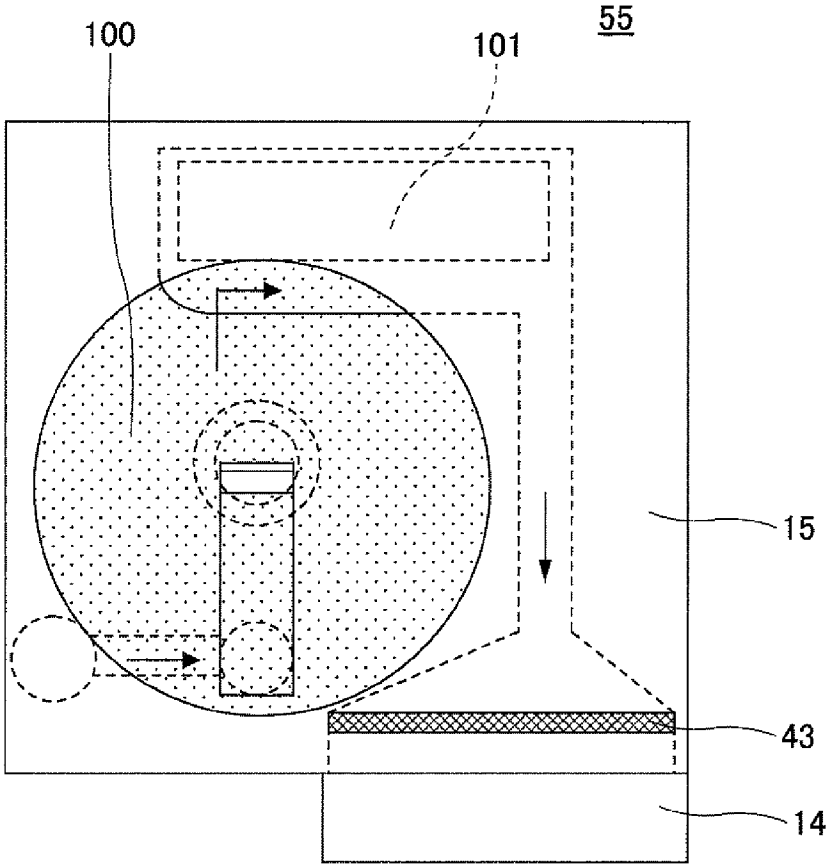

FIGS. 10A and 10B are a front view and a cross section, respectively, of the sub-tank 15 according to Embodiment 5. In accordance with the present embodiment, an upstream side filter 47*a* is provided in the air storing area 101. The upstream side filler 47*a* defines a space in the air storing area 101 before the channel 116*a*. In the following description, parts or components similar to those of the foregoing embodiments are designated with similar numerals and their description is omitted.

The ink supplied from the top of the sub-tank 15 is guided to the lower-most portion of the air storing area 101 and supplied into the air storing area 101 via the ink inlet 101*c* located at the bottom. The air storing area 101 includes a bubble storing area 101*r* in an upper portion, under which the upstream side filter 47*a* is disposed, separating the air storing area 101 into two portions. An upper end of the upstream side filter 47*a* is positioned higher than the upper end of the channel 116*a*. The upstream side filter 46 has a channel area much larger than the channel area of the channel 116*a*. Thus, the channel resistance of the upstream side filter 47*a* relative to the channel 116*a* is reduced.

The bubbles captured by the upstream side filter 47*a* are parted from the filter by the flow of ink and moved to the bubble storing area 101*r* at the top of the air storing area 101, where the bubbles are stored. If the stored bubbles reach the position of the channel 116*a*, the ink cannot be supplied from the air storing area 101. Thus, the volume of the bubble storing area 101*r* of the air storing area 101 is set to a value ("maximum assumed air amount") such that it can be expected that the bubbles will not reach the position of the channel 116*a* before the end of operable life of the head unit 55. This area corresponds to the area between the upper-most portion of the air storing area 101 and the upper edge of the upstream side filter 47*a*, as will be seen from FIGS. 10A and 10B.

In accordance with Embodiment 5, the ink is supplied via a lower portion of the air storing area 101, and then flows into the negative pressure portion 101 via the communicating channel 116*a* positioned at the top of the upstream side filter 47*a*. The ink is then sent from the top of the negative pressure portion 101 downward and supplied to the head 14 via a downstream filter 43 at a lower portion. A flow regulating member similar to the one used in Embodiment 4 may be provided in order to guide the ink flow along the side wall of the pressurizing portion, whereby the bubbles may be effectively separated from the ink.

By thus providing the upstream side filter 47*a* in the air storing area 101, the entry of bubbles into the fluid storing area 100 can be prevented before the bubbles enter the communicating channel 116*a*. Thus, the loss of negative-pressure by the expansion of the stored air caused by a temperature change in the environment can be prevented. The bubbles captured by the upstream side filter 47*a* are separated by the ink flow and moved to the bubble storing area 101*r*, so that the ink flow is not blocked by the bubbles captured by the upstream side filter 47*a*.

Thus, in accordance with an embodiment of the present invention, a bubble storing area is provided upstream of the valve, so that the loss of negative-pressure on the negative pressure side by a temperature change in the environment can be prevented. Thus, improved fluid substitution efficiency can be obtained while ensuring a sufficient amount of air stored in the bubble storing area, thus reducing the drainage volume.

Although this invention has been described in detail with reference to certain embodiments, variations and modifications exist within the scope and spirit of the invention as described and defined in the following claims.

The present application is based on Japanese Priority Application No. 2010-061011 filed Mar. 17, 2010, the entire contents of which are hereby incorporated by reference.

What is claimed is:

1. A droplet discharging apparatus for discharging droplets of a recording fluid, the droplet discharging apparatus comprising:

a tank;

a negative pressure portion formed in the tank;

a pressurizing portion formed in the tank and connected to the negative pressure portion via a communicating channel formed at a lower part of the tank, a longitudinal direction of the pressurizing portion being disposed vertically;

a valve configured to open or close the communicating channel;

a bubble storing area configured to separate and store bubbles of the recording fluid, the bubble storing area being located above the communicating channel in the pressurizing portion; and a supply opening for supplying the recording fluid into the pressurizing portion from the outside, wherein each of the pressurizing portion and the negative pressure portion has a continuous space that extends from a lower end of the tank to an upper end of the tank, a separation wall that extends from the lower end of the tank to the upper end of the tank is disposed at a central portion and between the pressurizing portion and the negative pressure portion to divide the pressurizing portion and the negative pressure portion, the communicating channel is formed at the lower part of the separation wall to penetrate through the separation wall laterally, and the valve opens and closes the communicating channel, and wherein the recording fluid flows from the pressurizing portion to the negative pressure portion via the communicating channel and the valve, the pressurizing portion is disposed upstream of the valve, the negative pressure portion is disposed downstream of the valve, and the supply opening is disposed under the communicating channel connected to the valve.

2. The droplet discharging apparatus according to claim 1, further comprising:

a filter disposed in a pressurizing area under the bubble storing area and configured to separate the bubbles, wherein the filter is disposed downstream of the supply opening and upstream of the communicating channel.

3. The droplet discharging apparatus according to claim 1, further comprising a regulating member disposed in the pressurizing portion and configured to regulate the flow of the recording fluid in the pressurizing portion.

4. The droplet discharging apparatus according to claim 3, wherein the regulating member is configured to regulate the flow of the recording fluid to follow a side wall of the pressurizing portion.

5. The droplet discharging apparatus according to claim 2, further comprising a regulating member disposed adjacent to the filter in the bubble storing area and configured to regulate the flow of the recording fluid in the pressurizing portion.

6. An image forming apparatus comprising the droplet discharging apparatus according to claim 1.

7. A bubble separating method performed in a droplet discharging apparatus for discharging droplets of a recording fluid, the droplet discharging apparatus including:

a tank;

a negative pressure portion formed in the tank;

a pressurizing portion formed in the tank and connected to the negative pressure portion via a communicating channel formed at a lower part of the tank, a longitudinal direction of the pressurizing portion being disposed vertically;

a valve configured to open or close the communicating channel;

a bubble storing area configured to separate and store bubbles of the recording fluid, the bubble storing area being located above the communicating channel in the pressurizing portion; and a supply opening for supplying the recording fluid into the pressurizing portion from the outside, wherein each of the pressurizing portion and the negative pressure portion has a continuous space that extends from a lower end of the tank to an upper end of the tank, a separation wall that extends from the lower end of the tank to the upper end of the tank is disposed at a central portion and between the pressurizing portion and the negative pressure portion to divide the pressurizing portion and the negative pressure portion, the communicating channel is formed at the lower part of the separation wall to penetrate through the separation wall laterally, and the valve opens and closes the communicating channel, and wherein the recording fluid flows from the pressurizing portion to the negative pressure portion via the communicating channel and the valve, the pressurizing portion is disposed upstream of the valve, the negative pressure portion is disposed downstream of the valve, and the supply opening is disposed under the communicating channel connected to the valve, and the method comprising:

supplying the recording fluid into the pressurizing portion from the outside;

separating bubbles in the recording fluid in the pressurizing portion; and storing the bubbles in the bubble storing area.

8. The droplet discharging apparatus according to claim 1, wherein a flexible film is welded onto a side of the negative pressure portion of the tank.

9. The droplet discharging apparatus according to claim 1, further comprising an upper channel formed at an upper part of the tank, wherein the recording fluid flows into a recording head disposed below the tank via the upper channel from the negative pressure portion.

10. A droplet discharging apparatus for discharging droplets of a recording fluid through a recording head, the droplet discharging apparatus comprising:

a head tank that receives the recording fluid from a main tank via a fluid channeling tube;

a negative pressure portion formed in the tank;

a pressurizing portion formed in the tank and connected to the negative pressure portion via a communicating channel formed at a lower part of the tank, a longitudinal direction of the pressurizing portion being disposed vertically;

a separation wall disposed vertically at a central portion of the head tank to divide the head tank into the negative pressure portion on a negative pressure portion side of the wall and the pressurizing portion on a pressurizing portion side of the wall;

a negative pressure control valve that controls negative pressure inside the head tank, and communication of the recording fluid between the pressurizing portion and the negative pressure portion which are partitioned by the wall;

a flexible film welded onto the pressurizing portion side of the head tank, the flexible film flexing in response to volume change in the head tank when the recording fluid is supplied from the negative pressure portion to the recording head;

a bias mechanism coupling the flexible film to the negative pressure control valve, to cause the negative pressure control valve to open when the flexible film contracts in response to decrease in the volume of the recording fluid in the head tank when the recording fluid is being discharged from the recording head, and to cause the negative pressure control valve to close and thereby block communication of the recording fluid between the pressurizing portion and the negative pressure portion when discharge of the recording fluid by the recording head is stopped; and a bubble storing area configured to separate and store bubbles of the recording fluid, the bubble storing area being disposed inside of the pressurizing portion and at an upper end of the head tank, wherein each of the pressurizing portion and the negative pressure portion has a continuous space that extends from a lower end of the head tank to an upper end of the head tank, the separation wall extends from the lower end of the tank to the upper end of the tank and is disposed at a central portion and between the pressurizing portion and the negative pressure portion to divide the pressurizing portion and the negative pressure portion, the communicating channel is formed at the lower art of the separation wall to penetrate through the separation wall laterally, and the valve opens and closes the communicating channel, and wherein the recording fluid flows from the pressurizing portion to the negative pressure portion via the communicating channel and the negative pressure control valve, the pressurizing portion is disposed upstream of the negative pressure control valve, and the negative pressure portion is disposed downstream of the negative pressure control valve.

* * * * *